US010612461B2

(12) United States Patent
Ito et al.

(10) Patent No.: US 10,612,461 B2
(45) Date of Patent: Apr. 7, 2020

(54) WATERCRAFT AND SYSTEM FOR OPERATING SAME

(71) Applicant: YAMAHA HATSUDOKI KABUSHIKI KAISHA, Iwata-shi, Shizuoka (JP)

(72) Inventors: Takuma Ito, Shizuoka (JP); Makoto Ito, Shizuoka (JP); Takuya Hayashi, Shizuoka (JP)

(73) Assignee: YAMAHA HATSUDOKI KABUSHIKI KAISHA, Shuzuoka (JP)

( * ) Notice: Subject to any disclaimer, the term of this patent is extended or adjusted under 35 U.S.C. 154(b) by 0 days.

(21) Appl. No.: 16/202,336

(22) Filed: Nov. 28, 2018

(65) Prior Publication Data

US 2019/0353093 A1 Nov. 21, 2019

(30) Foreign Application Priority Data

May 15, 2018 (JP) ..... 2018-093723

(51) Int. Cl.

| | |
|---|---|
| ***F02B 61/04*** | (2006.01) |
| ***B63H 20/00*** | (2006.01) |
| ***B63H 20/12*** | (2006.01) |
| ***B63H 5/08*** | (2006.01) |
| ***B63H 21/21*** | (2006.01) |

(52) U.S. Cl.

CPC ..... *F02B 61/045* (2013.01); *B63H 5/08* (2013.01); *B63H 20/00* (2013.01); *B63H 20/12* (2013.01); *B63H 21/21* (2013.01); *B63H 2020/003* (2013.01)

(58) Field of Classification Search

CPC . B63H 5/00; B63H 5/08; B63H 20/00; B63H 20/12; B63H 21/00; B63H 21/21; B63H 20/06; B63H 20/08; B63H 20/16; B63H 20/22; B63H 21/213; B63H 21/22; B63H 25/00; B63H 25/02; B63H 25/42; F02B 61/045

USPC ..... 440/1, 84, 86, 87

See application file for complete search history.

(56) References Cited

U.S. PATENT DOCUMENTS

| | | | | |
|---|---|---|---|---|
| 7,220,153 | B2 * | 5/2007 | Okuyama | B63H 21/22 440/1 |
| 7,497,748 | B2 | 3/2009 | Salmon | |

(Continued)

FOREIGN PATENT DOCUMENTS

| | | | |
|---|---|---|---|
| JP | 56-47398 | A | 4/1981 |
| JP | 3386521 | B2 | 3/2003 |
| JP | 2006-347499 | A | 12/2006 |

*Primary Examiner* — Lars A Olson

(74) *Attorney, Agent, or Firm* — Keating and Bennett, LLP

(57) ABSTRACT

A first outboard motor attached to a vessel body receives an electric operating signal and is controlled in accordance with the electric operating signal. A second outboard motor attached to the vessel body receives a mechanical operating amount and is controlled in accordance with the mechanical operating amount. An operating tool controls shifting and a throttle opening degree of each of the first and second outboard motors. The electric operating signal is transmitted through a first transmission path to the first outboard motor based on an operation of the operating tool. The mechanical operating amount is transmitted through a second transmission path to the second outboard motor based on an operation of the operating tool.

21 Claims, 10 Drawing Sheets

(56) References Cited

U.S. PATENT DOCUMENTS

| | | | | |
|---|---|---|---|---|
| 2006/0240720 | A1* | 10/2006 | Yamashita | B63H 20/12 440/1 |
| 2007/0082565 | A1* | 4/2007 | Okuyama | B63H 20/12 440/1 |
| 2014/0329422 | A1* | 11/2014 | Ito | B63H 20/12 440/1 |

* cited by examiner

WATERCRAFT AND SYSTEM FOR OPERATING SAME

CROSS REFERENCE TO RELATED APPLICATIONS

This application claims the benefit of priority to Japanese Patent Application No. 2018-093723 filed on May 15, 2018. The entire contents of this application are hereby incorporated herein by reference.

BACKGROUND OF THE INVENTION

1. Field of the Invention

The present invention relates to a watercraft and a system for operating the same.

2. Description of the Related Art

There is a type of watercraft including a plurality of different types of outboard motors. For example, as described in U.S. Pat. No. 7,497,748, there is a type of watercraft that includes a first outboard motor with a large horsepower as a main motor and a second outboard motor with a small horsepower as an auxiliary motor. When controlled by different systems, the first and second outboard motors are attached to a watercraft while being paired with tools for operating them, respectively. Therefore, the watercraft includes the first outboard motor, the tool for operating the first outboard motor (a first operating tool), the second outboard motor and the tool for operating the second outboard motor (a second operating tool).

For example, when the first outboard motor is controlled by an electric operating signal, the first operating tool outputs an electric signal, which indicates operating both shifting and a throttle opening degree of the first outboard motor, to the first outboard motor through an electric cable. By contrast, when the second outboard motor is controlled by a mechanical operating amount, the second operating tool outputs a mechanical operating amount, which indicates operating both shifting and a throttle opening degree of the second outboard motor, to the second outboard motor through, for instance, motions to push and pull a cable.

SUMMARY OF THE INVENTION

However, as described above, when the watercraft is equipped with the plural operating tools that are associated with the plural outboard motors, respectively, a system for operating the watercraft is made complex, and operating each outboard motor is made cumbersome. In view of this, improvement has been demanded for watercraft and systems for operating the watercraft such that a plurality of outboard motors are operable by making the systems for operating the watercraft as simple as possible.

A watercraft according to a first preferred embodiment of the present invention includes a vessel body, a first outboard motor, a second outboard motor, an operating tool, a first transmission path and a second transmission path. The first outboard motor is attached to a vessel body, receives an electric operating signal, and is controlled in accordance with the electric operating signal. The second outboard motor is attached to the vessel body, receives a mechanical operating amount, and is controlled in accordance with the mechanical operating amount. The operating tool controls shifting and a throttle opening degree of each of the first and second outboard motors. The electric operating signal is transmitted through the first transmission path to the first outboard motor based on an operation of the operating tool. The mechanical operating amount is transmitted through the second transmission path to the second outboard motor based on an operation of the operating tool.

A vessel operating system according to a second preferred embodiment of the present invention includes a first outboard motor, a second outboard motor, an operating tool, a first transmission path and a second transmission path. The first outboard motor receives an electric operating signal and is controlled in accordance with the electric operating signal. The second outboard motor receives a mechanical operating amount and is controlled in accordance with the mechanical operating amount. The operating tool controls shifting and a throttle opening degree of each of the first and second outboard motors. The electric operating signal is transmitted through the first transmission path to the first outboard motor based on an operation of the operating tool. The mechanical operating amount is transmitted through the second transmission path to the second outboard motor based on an operation of the operating tool.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
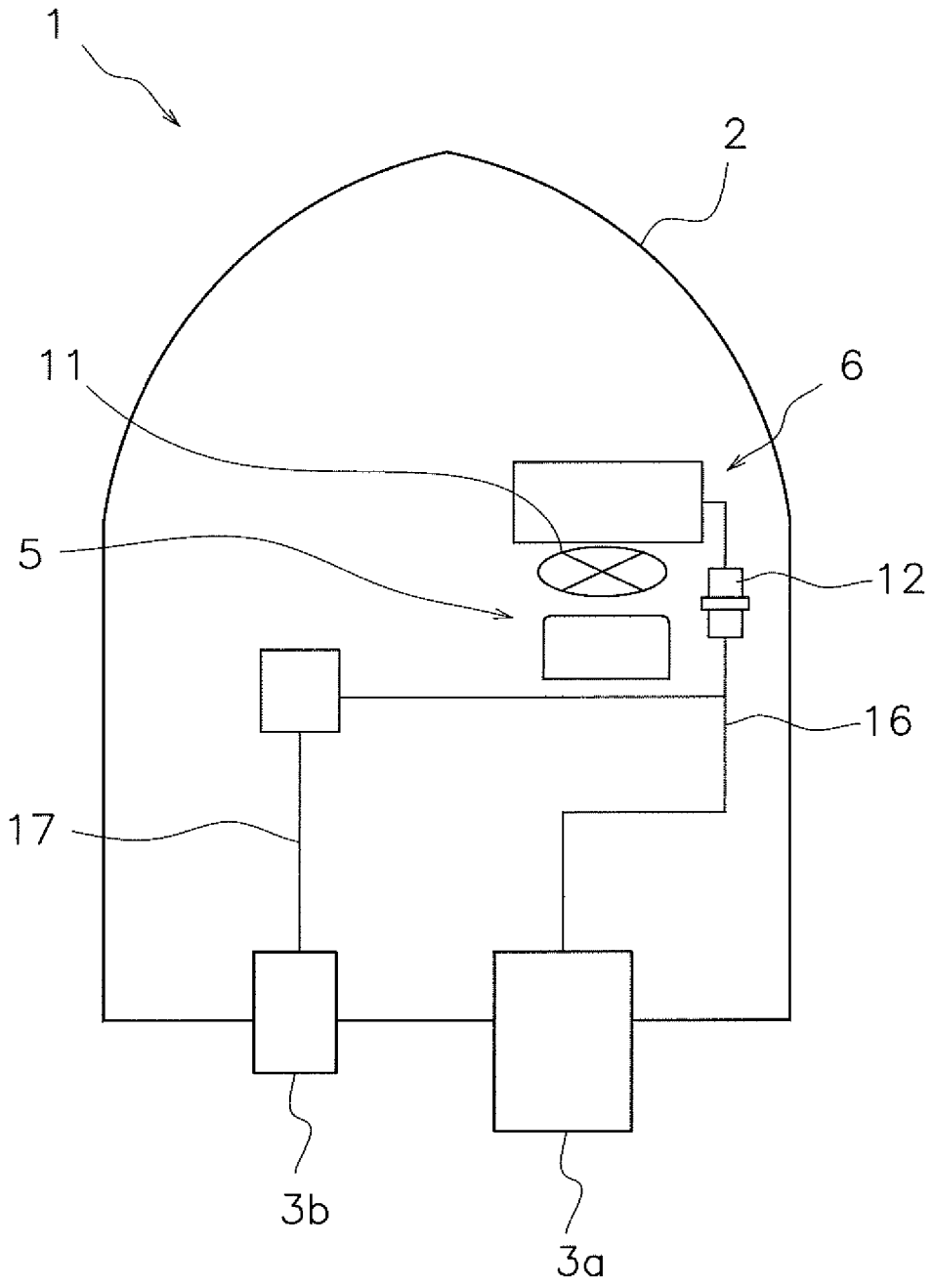
FIG. 1 is a schematic diagram of a watercraft according to a preferred embodiment of the present invention.

Preferred embodiments of the present invention, and modifications thereto, will be hereinafter explained with reference to drawings. FIG. 1 is a schematic diagram of a watercraft 1 according to a preferred embodiment of the present invention. As shown in FIG. 1, the watercraft 1 includes a vessel body 2, a first outboard motor 3*a* and a second outboard motor 3*b*. The vessel body 2 includes an operator seat 5. Adjacent to the operator seat 5 is a vessel operating device 6 including a steering wheel 11 and so forth. Each of the first and second outboard motors 3*a* and 3*b* generates a thrust to propel the watercraft 1. Each of the first and second outboard motors 3*a* and 3*b* is attached to the stern of the vessel body 2.

Figure 2:
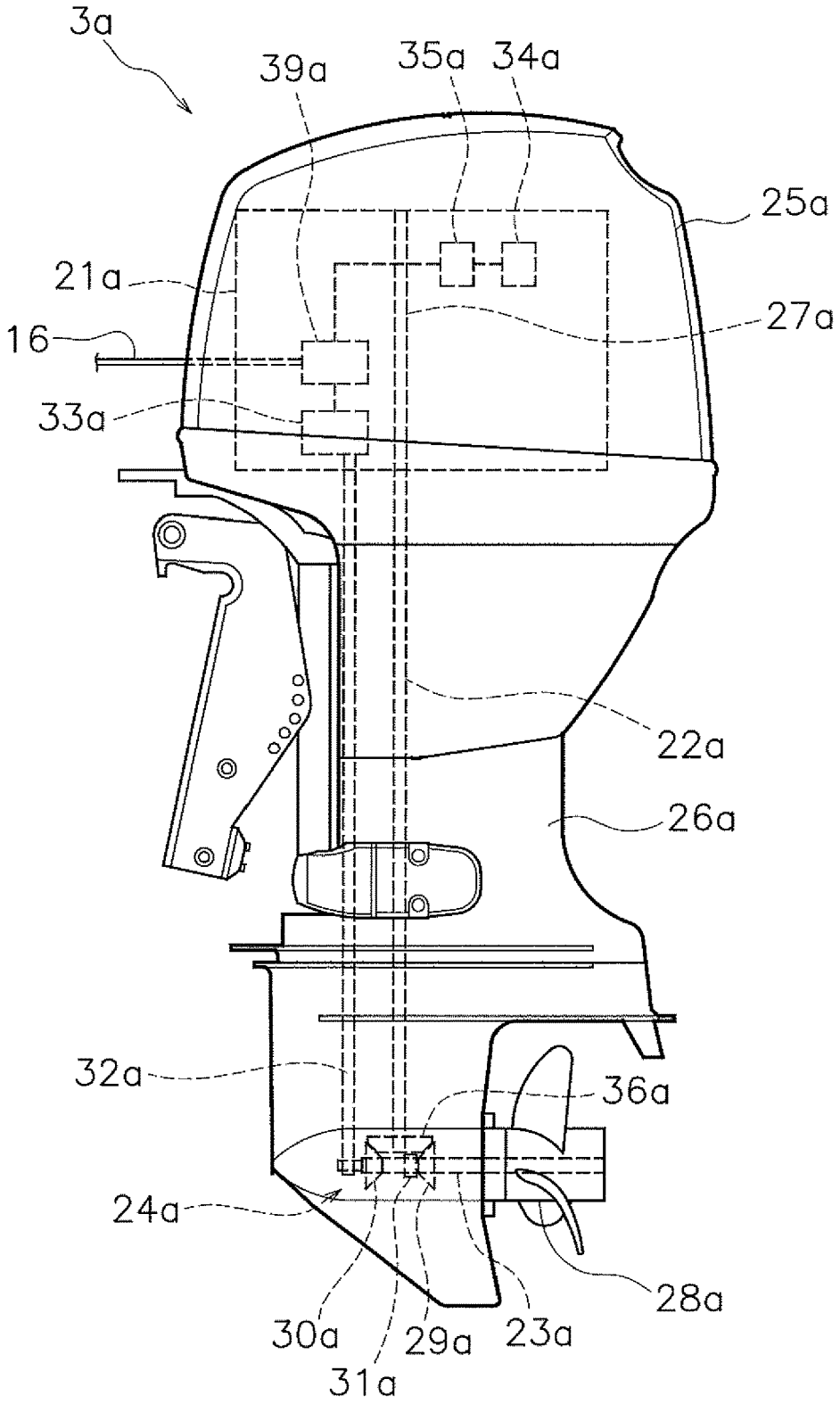
FIG. 2 is a side view of a first outboard motor.

FIG. 2 is a side view of the first outboard motor 3*a*. The first outboard motor 3*a* includes an engine 21*a*, a drive shaft 22*a*, a propeller shaft 23*a*, a shift mechanism 24*a*, an engine cover 25*a* and a housing 26*a*. The engine 21*a* generates the thrust to propel the watercraft 1. The engine 21*a* is disposed inside the engine cover 25*a*. The engine 21*a* includes a crankshaft 27*a*. The crankshaft 27*a* extends in the vertical direction. The drive shaft 22*a* is connected to the crankshaft 27*a*. The drive shaft 22*a* extends in the vertical direction.

The propeller shaft 23*a* extends in the back-and-forth direction. The propeller shaft 23*a* is connected to the drive shaft 22*a* through the shift mechanism 24*a*. A propeller 28*a* is connected to the propeller shaft 23*a*. The housing 26*a* is disposed below the engine cover 25*a*. The drive shaft 22*a*, the propeller shaft 23*a* and the shift mechanism 24*a* are disposed inside the housing 26*a*.

The shift mechanism 24*a* switches the rotational direction of power transmitted from the drive shaft 22*a* to the propeller shaft 23*a*. The shift mechanism 24*a* includes a plurality of gears and a clutch that changes meshing of the plurality of gears. For example, the shift mechanism 24*a* includes a forward moving gear 29*a*, a rearward moving gear 30*a* and a clutch 31*a*. The forward moving gear 29*a* and the rearward moving gear 30*a* are meshed with a bevel gear 36*a* attached to the drive shaft 22*a*. The clutch 31*a* selectively causes either the forward moving gear 29*a* or the rearward moving gear 30*a* to be engaged with the propeller shaft 23*a*. The clutch 31*a* is movable to a forward moving position, a rearward moving position and a neutral position.

When in the forward moving position, the clutch 31*a* causes the forward moving gear 29*a* to be engaged with the propeller shaft 23*a*. Accordingly, the rotation of the drive shaft 22*a* is transmitted to the propeller shaft 23*a* so as to rotate the propeller shaft 23*a* in a forward moving direction. When in the rearward moving position, the clutch 31*a* causes the rearward moving gear 30*a* to be engaged with the propeller shaft 23*a*. Accordingly, the rotation of the drive shaft 22*a* is transmitted to the propeller shaft 23*a* so as to rotate the propeller shaft 23*a* in a rearward moving direction. When in the neutral position, the clutch 31*a* causes both the forward moving gear 29*a* and the rearward moving gear 30*a* to be disengaged from the propeller shaft 23*a*. Accordingly, the rotation of the drive shaft 22*a* is not transmitted to the propeller shaft 23*a*.

The first outboard motor 3*a* includes a shift member 32*a* and a shift actuator 33*a*. The shift member 32*a* is connected to the clutch 31*a*. When driven by the shift actuator 33*a*, the shift member 32*a* moves the clutch 31*a* to one of the forward moving position, the rearward moving position and the neutral position. For example, the shift member 32*a* is a rod. When the shift member 32*a* is rotated in a predetermined direction, the clutch 31*a* is moved from the forward moving position to the rearward moving position via the neutral position. When the shift member 32*a* is rotated reversely to the predetermined direction, the clutch 31*a* is moved from the rearward moving position to the forward moving position via the neutral position. However, the shift member 32*a* is not limited to the rod, and alternatively, may be another member such as a wire.

The shift actuator 33*a* is connected to the shift member 32*a* and drives the shift member 32*a*. The shift actuator 33*a* is, for instance, an electric motor. The shift actuator 33*a* drives the shift member 32*a* so as to switch the clutch 31*a* to one of the forward moving position, the rearward moving position and the neutral position. In other words, the shift actuator 33*a* switches the shift mechanism 24*a* among a forward moving state, a rearward moving state and a neutral state.

The first outboard motor 3*a* includes a throttle valve 34*a* and a throttle actuator 35*a*. The throttle valve 34*a* regulates the intake amount of the engine 21*a*. The throttle actuator 35*a* controls the opening degree of the throttle valve 34*a*. The throttle actuator 35*a* is, for instance, an electric motor.

The first outboard motor 3*a* includes an engine ECU (Electronic Control Unit) 39*a*. The engine ECU 39*a* includes a processor such as a CPU and memories such as a RAM and a ROM. The engine ECU 39*a* stores programs and data that control the first outboard motor 3*a*. The engine ECU 39*a* is communicably connected to the shift actuator 33*a* and the throttle actuator 35*a*. The engine ECU 39*a* controls the shift actuator 33*a* so as to switch the shift mechanism 24*a* of the first outboard motor 3*a* among the forward moving state, the rearward moving state and the neutral state. The engine ECU 39*a* controls the throttle actuator 35*a* so as to control the rotational speed of the engine 21*a*.

Figure 3:
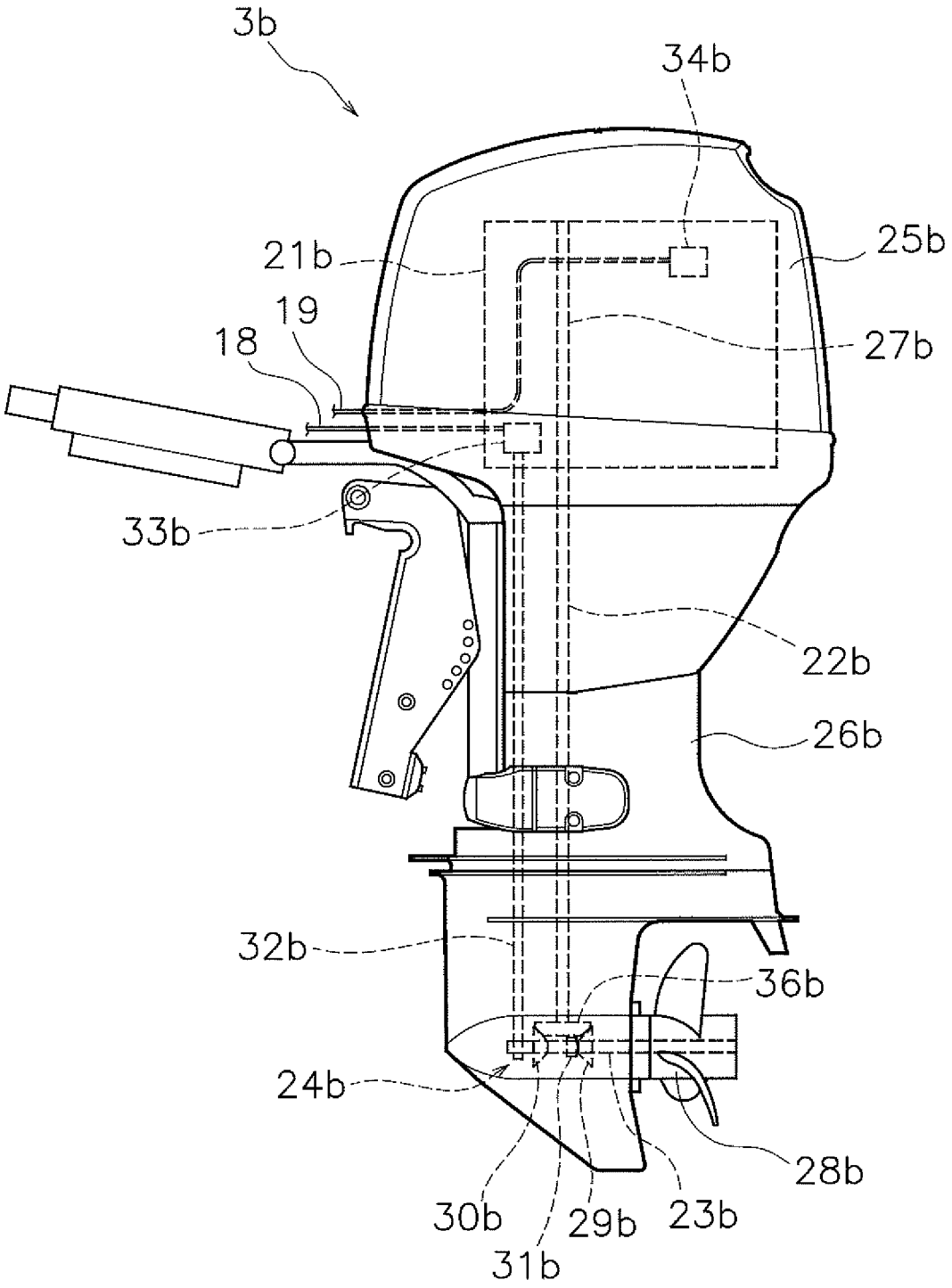
FIG. 3 is a side view of a second outboard motor.

FIG. 3 is a side view of the second outboard motor 3*b*. The second outboard motor 3*b* includes an engine 21*b*, a drive shaft 22*b*, a propeller shaft 23*b*, a shift mechanism 24*b*, an engine cover 25*b*, a housing 26*b* and a propeller 28*b*. The second outboard motor 3*b* is an outboard motor having a smaller horsepower than the first outboard motor 3*a*. For example, the engine 21*b* of the second outboard motor 3*b* has a smaller displacement than the engine 21*a* of the first outboard motor 3*a*.

The shift mechanism 24*b* of the second outboard motor 3*b* includes a forward moving gear 29*b*, a rearward moving gear 30*b*, a clutch 31*b* and a bevel gear 36*b*. These elements of the second outboard motor 3*b* are basically the same as those of the first outboard motor 3*a* described above, and hence, a detailed explanation thereof will be omitted.

The second outboard motor 3*b* includes a shift member 32*b* and a shift link mechanism 33*b*. The shift member 32*b* is connected to the clutch 31*b* of the shift mechanism 24*b*. The shift link mechanism 33*b* is connected to a shift cable 18 to be described later. The shift link mechanism 33*b* transmits the motion of the shift cable 18 to the shift member 32*b*. The shift link mechanism 33*b* includes a mechanical element such as a cam, a gear or so forth, and transmits the motion of the shift cable 18 to the shift member 32*b* by the mechanical motion thereof. In the second outboard motor 3*b*, the shift member 32*b*, when driven by the shift cable 18, moves the clutch 31*b* to one of the forward moving position, the rearward moving position and the neutral position.

The second outboard motor 3*b* includes a throttle valve 34*b*. The throttle valve 34*b* regulates the intake amount of the engine 21*b*. The throttle valve 34*b* is connected to a throttle cable 19. In the second outboard motor 3*b*, the opening degree of the throttle valve 34*b* is controlled by the motion of the throttle cable 19.

Figure 4:
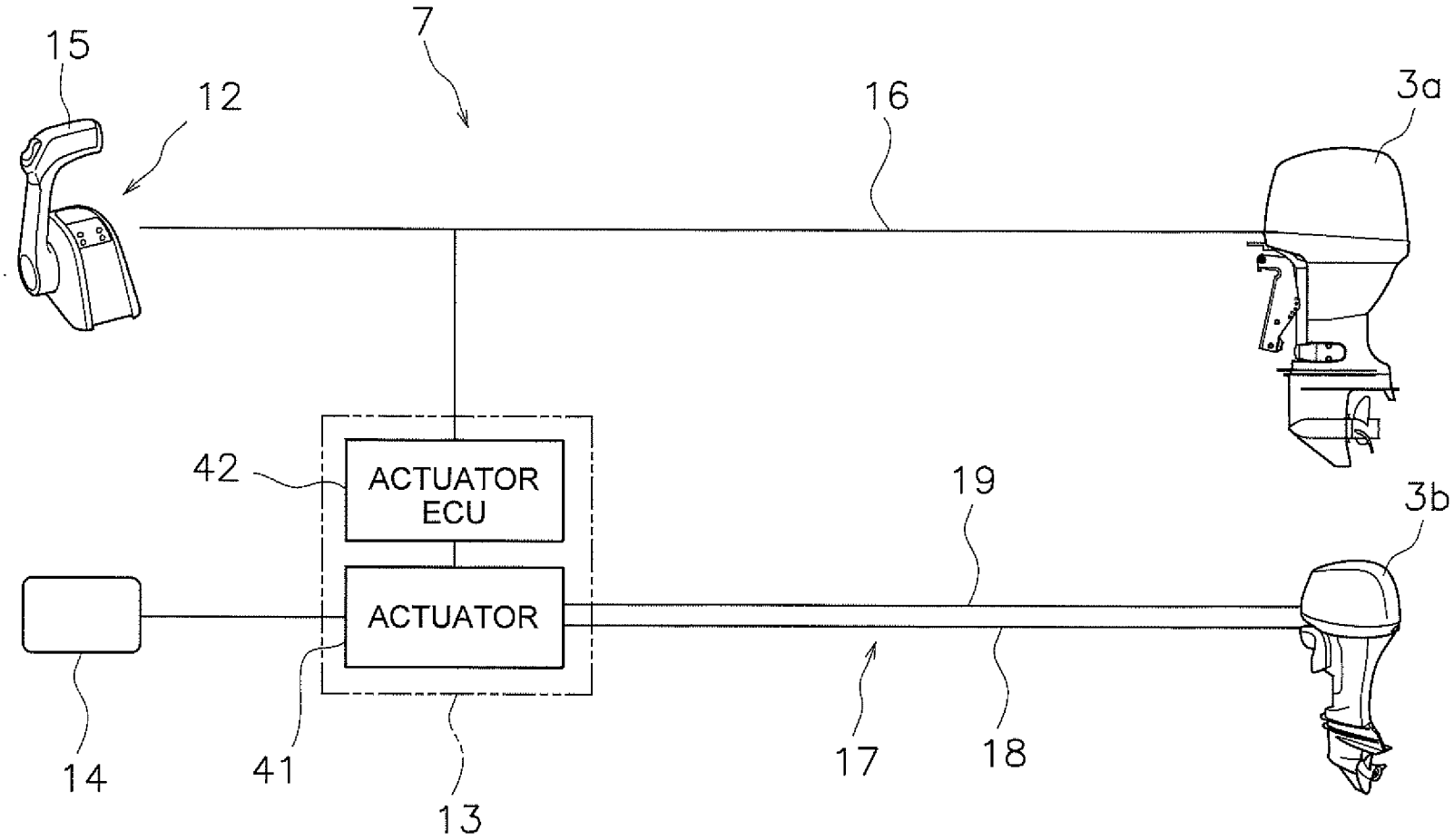
FIG. 4 is a schematic diagram of a system for operating the watercraft.

FIG. 4 is a schematic diagram of a vessel operating system 7 for the watercraft 1. As shown in FIG. 4, the vessel operating system 7 includes a remote control 12, an actuator unit 13 and an operational switch 14. The remote control 12 is disposed at the operator seat 5. The remote control 12 includes an operating tool 15. The operating tool 15 is a member by which an operator controls both shifting and the throttle opening degree in each of the first and second outboard motors 3*a* and 3*b*.

The operating tool 15 is movable among the forward moving position, the neutral position and the rearward moving position. The remote control 12 outputs an electric operating signal, which indicates operating both shifting and throttle opening degree, in accordance with the position of the operating tool 15. The operating tool 15 is, for instance, a lever. However, the operating tool 15 is not limited to the lever, and alternatively, may be another type of device such as a switch, a joystick, a touchscreen or so forth.

The remote control 12 is communicably connected to the engine ECU 39*a* of the first outboard motor 3*a*. The remote control 12 is connected to the engine ECU 39*a* of the first outboard motor 3*a* through a first transmission path 16. For example, the first transmission path 16 is an electric cable that transmits an electric signal.

An electric operating signal is outputted from the remote control 12 and is transmitted through the first transmission path 16 to the engine ECU 39*a* of the first outboard motor 3*a*. The first outboard motor 3*a* receives the electric operating signal from the remote control 12 through the first transmission path 16, and is controlled in accordance with the electric operating signal.

The actuator unit 13 is connected to the remote control 12 through the first transmission path 16. The actuator unit 13 is connected to the second outboard motor 3*b* through a second transmission path 17. The second transmission path 17 includes the shift cable 18 and the throttle cable 19. A mechanical operating amount is transmitted through the second transmission path 17 to the second outboard motor 3*b* based on an operation of the operating tool 15.

The mechanical operating amount is indicated by the motion amount of the shift cable 18. The mechanical operating amount is also indicated by the motion amount of the throttle cable 19. For example, the mechanical operating amount is indicated by the motion amount of pushing and pulling each of the shift cable 18 and the throttle cable 19. However, the mechanical operating amount may be indicated by the amount of another type of motion such as rotation of each of the shift cable 18 and the throttle cable 19.

The actuator unit 13 converts an electric operating amount, inputted thereto from the remote control 12 through the first transmission path 16, into a mechanical operating amount, and then transmits the mechanical operating amount to the second outboard motor 3*b* through the second transmission path 17. The second outboard motor 3*b* receives the mechanical operating amount through the second transmission path 17, and is controlled in accordance with the mechanical operating amount.

More specifically, the actuator unit 13 includes an actuator 41 and an actuator ECU 42. The actuator 41 is connected to the second transmission path 17. The actuator ECU 42 includes a processor such as a CPU and memories such as a RAM and an ROM. The actuator ECU 42 stores programs and data that control the actuator 41. The actuator ECU 42 is communicably connected to the actuator 41. The actuator ECU 42 controls the actuator 41.

Figure 5:
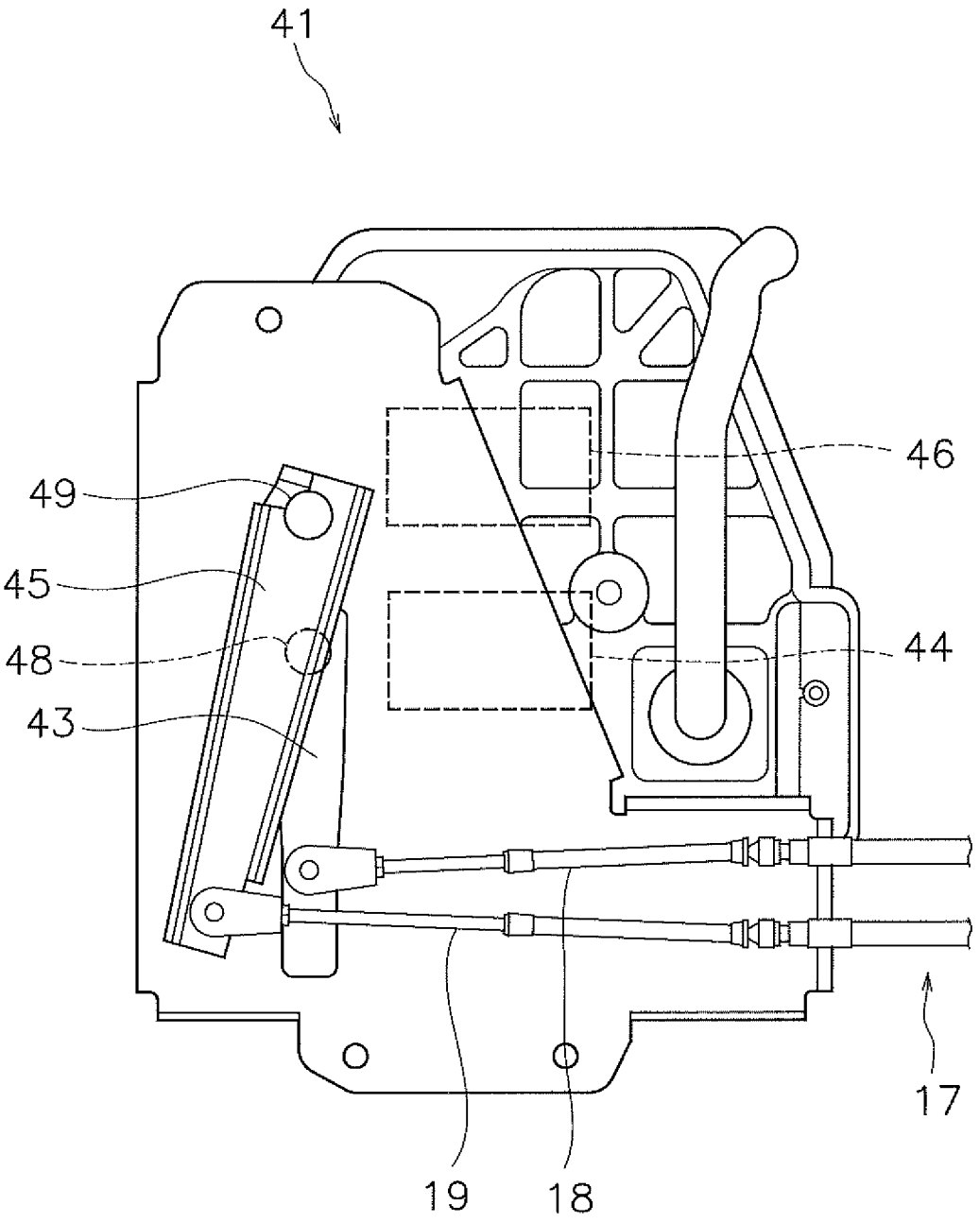
FIG. 5 is a configuration diagram of an actuator.

FIG. 5 is a configuration diagram of the actuator 41. The actuator 41 includes a first movable member 43 and a first motor 44. The first movable member 43 is connected to the shift cable 18. The first motor 44 is connected to the first movable member 43 through a gear (not shown in the drawing), and drives the first movable member 43. The first motor 44 is, for instance, an electric motor. When driven by the first motor 44, the first movable member 43 actuates the shift cable 18. For example, when driven by the first motor 44, the first movable member 43 is rotated about a rotational shaft 48 and thus pushes and pulls the shift cable 18.

The actuator 41 includes a second movable member 45 and a second motor 46. The second movable member 45 is connected to the throttle cable 19. The second motor 46 is connected to the second movable member 45 through a gear (not shown in the drawing), and drives the second movable member 45. The second motor 46 is, for instance, an electric motor. When driven by the second motor 46, the second movable member 45 actuates the throttle cable 19. For example, when driven by the second motor 46, the second movable member 45 is rotated about a rotational shaft 49 and thus pushes and pulls the throttle cable 19.

However, the first movable member 43 and/or the second movable member 45 may be linearly movable. The motion of the shift cable 18 and that of the throttle cable 19 are not limited to the push-and-pull motion, and alternatively, may be another type of motion such as rotation.

Figure 6:
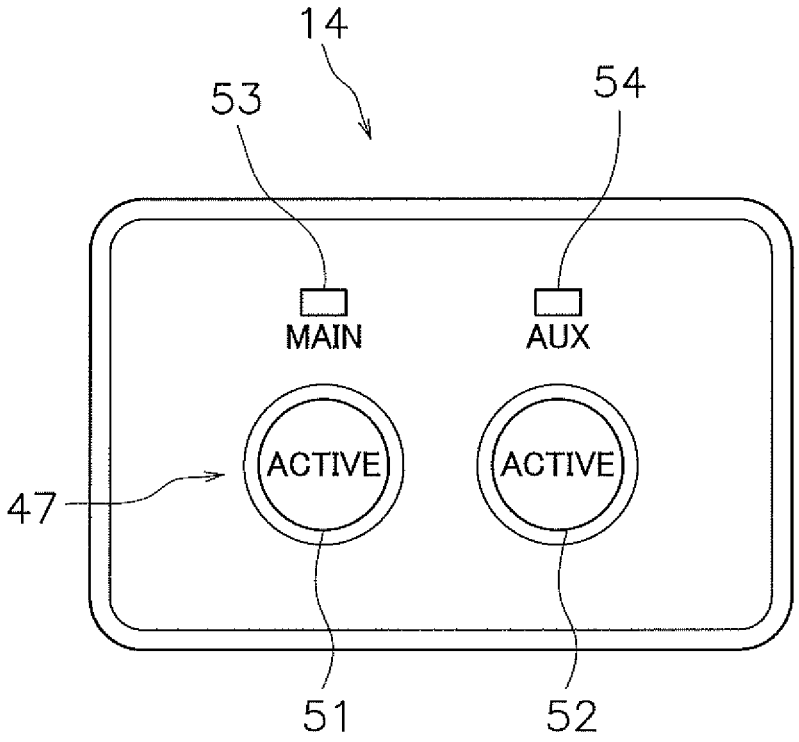
FIG. 6 is a configuration diagram of an operational switch.

The operational switch 14 switches which of the first and second outboard motors 3*a* and 3*b* is operated by the operating tool 15. The operational switch 14 is connected to the actuator unit 13. FIG. 6 is a diagram showing the operational switch 14. As shown in FIG. 6, the operational switch 14 includes a selection switch 47. The operator is able to select which of the first outboard motor 3*a* and the second outboard motor 3*b* is made operable or active by operating the selection switch 47.

The selection switch 47 includes a first switch 51 and a second switch 52. When the first switch 51 is pressed, the operational switch 14 outputs a command signal to make the first outboard motor 3*a* operable. When the second switch 52 is pressed, the operational switch 14 outputs a command signal to make the second outboard motor 3*b* operable. The command signal, outputted from the operational switch 14, is transmitted to the actuator ECU 42.

The operational switch 14 includes a first indicator 53 and a second indicator 54. The first indicator 53 is lit when the first outboard motor 3*a* is made operable. The second indicator 54 is lit when the second outboard motor 3*b* is made operable.

It should be noted that the selection switch 47 is not limited to the push-button switch, and alternatively, may be another type of switch such as a slide switch or a rotary switch. The selection switch 47 may be a switch movable to a first position and a second position. When the selection switch 47 is in the first position, the first outboard motor 3*a* is made operable. When the selection switch 47 is in the second position, the second outboard motor 3*b* is made operable. Alternatively, the selection switch 47 may be a touchscreen switch.

When the first outboard motor 3*a* is made operable, the electric operating signal, outputted from the operating tool 15, is transmitted to the engine ECU 39*a* of the first outboard motor 3*a* through the first transmission path 16. For example, when the operating tool 15 is operated from the neutral position toward the forward moving position when the first outboard motor 3*a* is made operable, the engine ECU 39*a* in the first outboard motor 3*a* controls the shift actuator 33*a* such that the shift mechanism 24*a* in the first outboard motor 3*a* is switched from the neutral state to the forward moving state in accordance with the electric operating signal inputted thereto from the remote control 12. Additionally, the engine ECU 39*a* controls the throttle actuator 35*a* such that the throttle opening degree is regulated in accordance with the operating amount of the operating tool 15.

When the operating tool 15 is operated from the neutral position toward the rearward moving position when the first outboard motor 3*a* is made operable, the engine ECU 39*a* controls the shift actuator 33*a* such that the shift mechanism 24*a* in the first outboard motor 3*a* is switched from the neutral state to the rearward moving state in accordance with the electric operating signal inputted thereto from the remote control 12. Additionally, during rearward movement, the engine ECU 39*a* similarly controls the throttle actuator 35*a*, as it does in the forward movement, such that the throttle operating degree is regulated in accordance with the operating amount of the operating tool 15.

It should be noted that when the first outboard motor 3*a* is made operable, operating the second outboard motor 3*b* is made inoperable or inactive. For example, when the second outboard motor 3*b* is inoperable, the shift mechanism 24*b* in the second outboard motor 3*b* is kept in the neutral state.

When receiving the command signal to make the second outboard motor 3*b* operable from the operational switch 14, the actuator ECU 42 computes the mechanical operating amount in accordance with the electric operating signal inputted thereto from the remote control 12, and controls the actuator 41 to output the mechanical operating amount to the second outboard motor 3*b* through the second transmission path 17.

Figure 7:
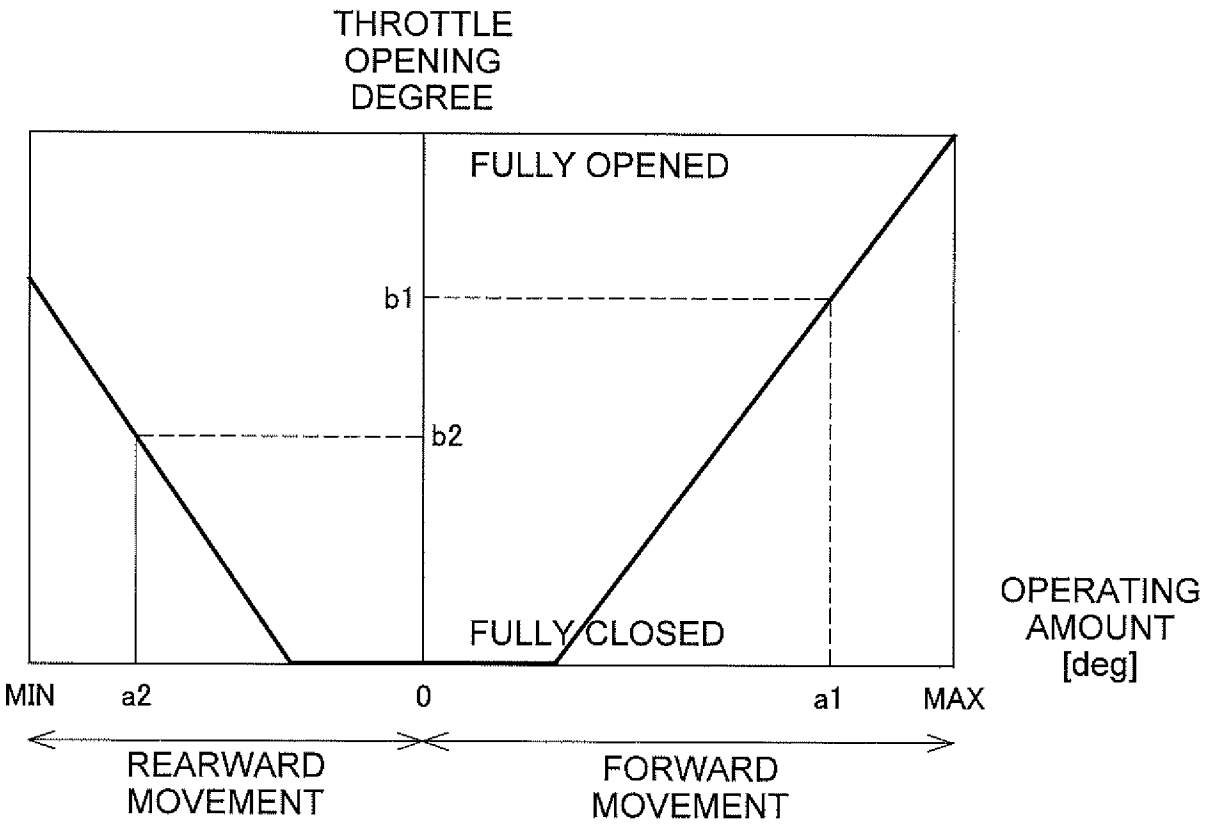
FIG. 7 is a chart showing an example of operating amount information.

The actuator ECU 42 includes operating amount information that defines the relationship between the electric operating signal and the mechanical operating amount. The actuator ECU 42 converts the electric operating signal into the mechanical operating amount with reference to the operating amount information. FIG. 7 is a chart showing an example of the operating amount information. In FIG. 7, the horizontal axis indicates the operating amount of the operating tool 15 of the remote control 12. The operating amount is expressed by the rotational angle of the operating tool 15 from the neutral position. However, the operating amount may be another parameter such as the stroke amount of the operating tool 15 from the neutral position. The vertical axis indicates the throttle opening degree. The throttle opening degree corresponds to the motion amount of the throttle cable 19.

Explanation will be hereinafter made regarding control of the actuator unit 13 in a condition that the second outboard motor 3*b* is made operable by the operational switch 14. For example, when the operating tool 15 is operated from the neutral position toward the forward moving position, the actuator ECU 42 causes the actuator 41 to actuate the shift cable 18 such that the shift mechanism 24*a* in the second outboard motor 3*b* is switched from the neutral state into the forward moving state. As shown in FIG. 7, when the operating amount of the operating tool 15 is "a1", the actuator ECU 42 sets a value "b1" corresponding to the operating amount "a1", as the throttle opening degree with reference to the operating amount information. The actuator ECU 42 causes the actuator 41 to actuate the throttle cable 19 such that the throttle opening degree of the engine 21*b* in the second outboard motor 3*b* is regulated to "b1".

When the operating tool 15 is operated from the neutral position toward the rearward moving position, the actuator ECU 42 causes the actuator 41 to actuate the shift cable 18 such that the shift mechanism 24*a* in the second outboard motor 3*b* is switched from the neutral state into the rearward moving state. As shown in FIG. 7, when the operating amount of the operating tool 15 is "a2", the actuator ECU 42 sets a value "b2" corresponding to the operating amount "a2" as the throttle opening degree with reference to the operating amount information. The actuator ECU 42 causes the actuator 41 to actuate the throttle cable 19 such that the throttle opening degree of the engine 21*a* in the second outboard motor 3*b* is regulated to "b2".

It should be noted that when the second outboard motor 3*b* is made operable, the first outboard motor 3*a* is made inoperable. For example, when the first outboard motor 3*a* is inoperable, the shift mechanism 24*a* in the first outboard motor 3*a* is kept in the neutral state.

In the watercraft 1 and the vessel operating system 7 according to the preferred embodiments explained above, the first outboard motor 3*a*, which is an electronically controlled type, and the second outboard motor 3*b*, which is a mechanically controlled type, may be operated by the common remote control 12. Therefore, it is not required to provide different remote controls provided for the outboard motors, respectively, on the watercraft 1. Hence, the configuration around the operator seat 5 is simple.

For example, during long distance movement of the watercraft 1 that includes the first outboard motor 3*a* as a main motor and the second outboard motor 3*b* as an auxiliary motor, the first outboard motor 3*a* is made operable such that the first outboard motor 3*a* is operable by the remote control 12. By contrast, during minute positional adjustment or short distance movement of the watercraft 1, the second outboard motor 3*b* is made operable such that the second outboard motor 3*b* is operable by the remote control 12.

Additionally, in the watercraft 1 and the vessel operating system 7 according to present preferred embodiments described above, the second outboard motor 3*b*, which is a mechanically controlled type, is electronically controllable by the actuator unit 13. Therefore, the second outboard motor 3*b* is able to be effectively controlled by electronic control by making the operating amount information suitable for the second outboard motor 3*b*.

Preferred embodiments of the present invention have been explained above. However, the present invention is not limited to the above-described preferred embodiments, and a variety of changes can be made without departing from the gist of the present invention.

In the above-described preferred embodiments, the watercraft 1 includes the first outboard motor 3*a* as only one electronically controlled outboard motor. However, the number of electronically controlled outboard motors may be two or greater. In the above-described preferred embodiments, the watercraft 1 includes the second outboard motor 3*b* as only one mechanically controlled outboard motor. However, the number of mechanically controlled outboard motors may be two or greater. The horsepower of the second outboard motor 3*b* is not limited to be smaller than that of the first outboard motor 3*a*, and alternatively, may be equivalent to or larger than that of the first outboard motor 3*a*.

The structure of the actuator unit 13 is not limited to that described in the above-described preferred embodiments, and may be changed. The first transmission path 16 is not limited to the electric cable, and may be changed. For example, the first transmission path 16 may include wireless communication. The second transmission path 17 is not limited to the cable, and may be changed. For example, the second transmission path 17 may include other mechanical elements such as a rod, a gear and a cam.

The electric operating signal, transmitted to the first outboard motor 3*a* through the first transmission path 16, is not limited to indicate both shifting and throttle opening degree, and alternatively, may indicate only shifting, only throttle opening degree, or another type of parameter such as the steering angle of the first outboard motor 3*a*. Likewise, the mechanical operating amount, transmitted to the second outboard motor 3*b* through the second transmission path 17, is not limited to indicate both shifting and throttle opening degree, and alternatively, may indicate only shifting, only throttle opening degree, or another type of parameter such as the steering angle of the second outboard motor 3*b*.

The configuration that controls the second outboard motor 3*b* by the actuator unit 13 is not limited to that in the above-described preferred embodiments. For example, the actuator unit 13 may cause the second outboard motor 3*b* to execute a vessel operating mode enabled by an electronically controlled outboard motor. The vessel operating mode includes, for instance, a fixed spot keeping mode and/or an autopilot mode. The fixed spot keeping mode is a mode that keeps the watercraft 1 in a predetermined position. The autopilot mode is a mode that keeps the vessel velocity of the watercraft 1 at a predetermined velocity.

Figure 8:
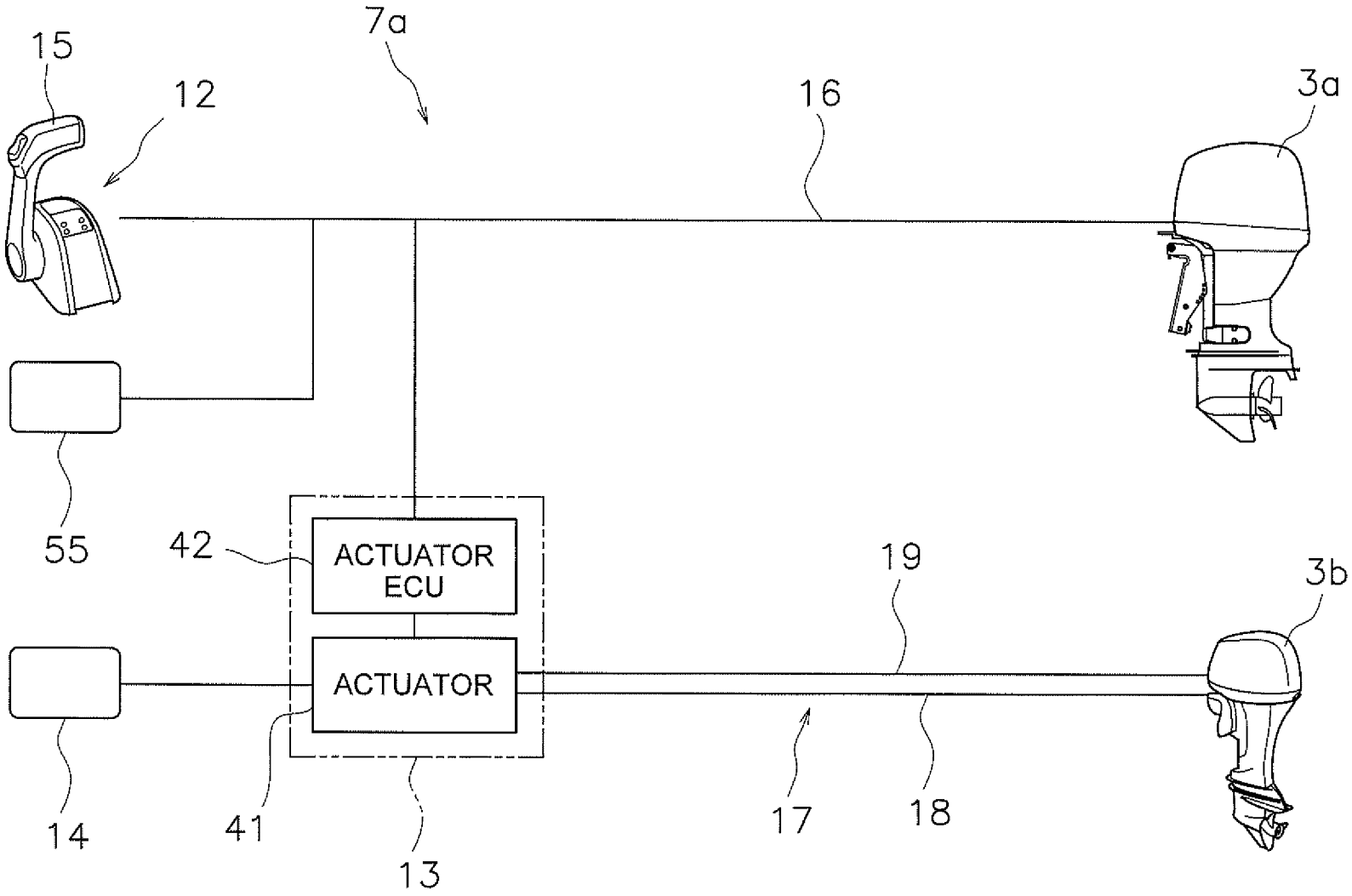
FIG. 8 is a schematic diagram of a system for operating a watercraft according to a modified preferred embodiment of the present invention.

FIG. 8 is a schematic diagram of a vessel operating system 7*a* according to a first modified preferred embodiment of the present invention. The vessel operating system 7*a* includes a selector device 55 that selects vessel operating modes. The operator operates the selector device 55 to select one of the vessel operating modes. The selector device 55 outputs a signal indicating the selected one of the vessel operating modes. The signal, indicating the selected one of the vessel operating modes, is inputted to the engine ECU 39*a* in the first outboard motor 3*a*. The signal, indicating the selected one of the vessel operating modes, is inputted to the actuator unit 13 as well.

The selector device 55 may include a mechanical switch, or alternatively, may be a touchscreen. The selector device 55 may be integral with or separate from the remote control 12.

When the fixed position keeping mode is selected by the selector device 55 when the second outboard motor 3*b* is made operable, the actuator unit 13 controls both shifting and the throttle opening degree of the second outboard motor 3*b* by outputting the mechanical operating amount to the second outboard motor 3*b* through the second transmission path 17 so as to keep the watercraft 1 in the predetermined position. When the autopilot mode is selected by the selector device 55 when the second outboard motor 3*b* is made operable, the actuator unit 13 controls both shifting and the throttle opening degree of the second outboard motor 3*b* by outputting the mechanical operating amount to the second outboard motor 3*b* through the second transmission path 17 so as to keep the vessel velocity at the predetermined velocity.

Figure 9:
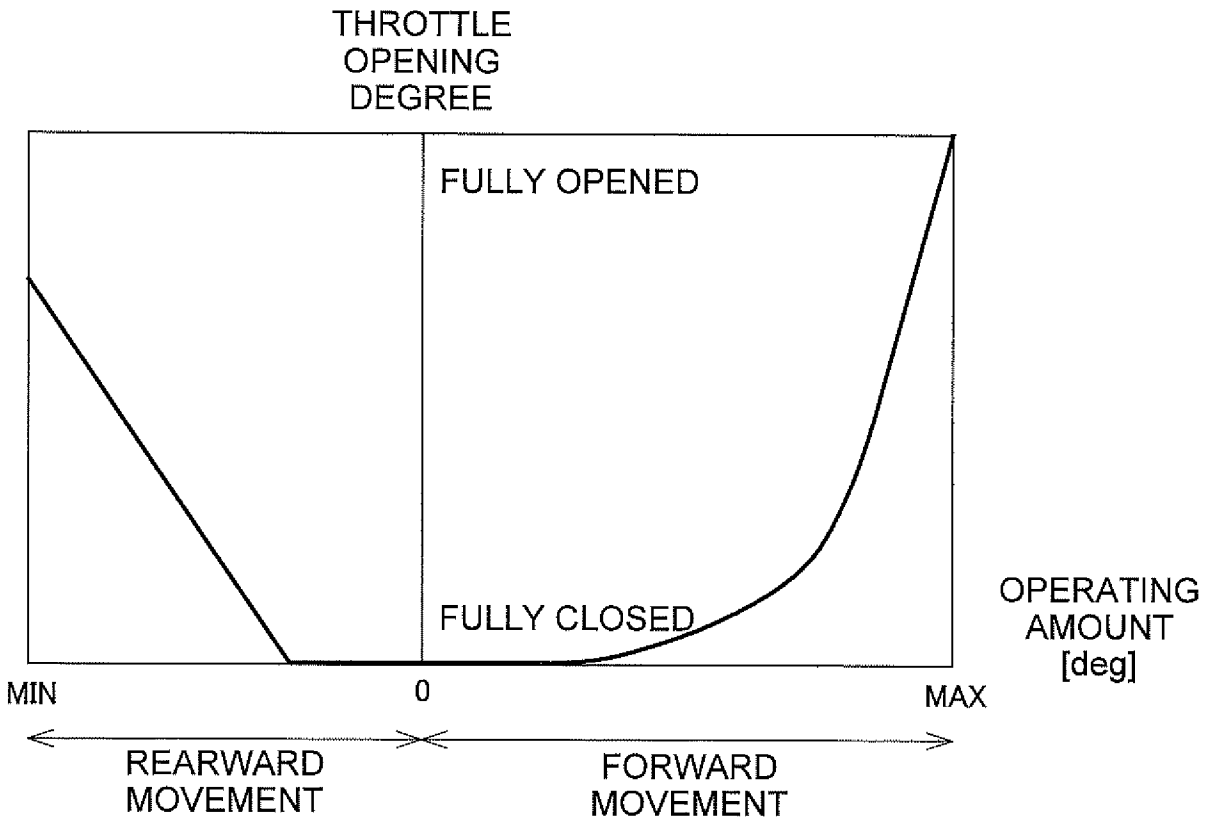
FIG. 9 is a chart showing operating amount information according to a modified preferred embodiment of the present invention.

The operating amount information is not limited to the operating amount information shown in FIG. 7 and may be changed. For example, FIG. 9 is a chart showing operating amount information according to modified preferred embodiments of the present invention. In the operating amount information shown in FIG. 7, the throttle opening degree linearly increases/decreases with an increase/decrease in the operating amount of the operating tool 15 in both forward movement and rearward movement. By contrast, in the operating amount information shown in FIG. 9, increase/decrease in the throttle opening degree with respect to an increase/decrease in the operating amount is lower in a low velocity range of forward movement than in a high velocity range of forward movement. When the actuator unit 13 refers to the operating amount information, minute regulation of the vessel velocity is easier in the low velocity range.

It should be noted that the actuator unit 13 may include the operating amount information shown in FIG. 9 instead of that shown in FIG. 7. Alternatively, the actuator unit 13 may include both the operating amount information shown in FIG. 7 (first operating amount information) and the operating amount information shown in FIG. 9 (second operating amount information). The actuator unit 13 may selectively refer to one of the first operating amount information and the second operating amount information. Similarly to the above-described vessel operating modes, one of the first operating amount information and the second operating amount information may be selected by the selector device 55 shown in FIG. 8.

Figure 10:
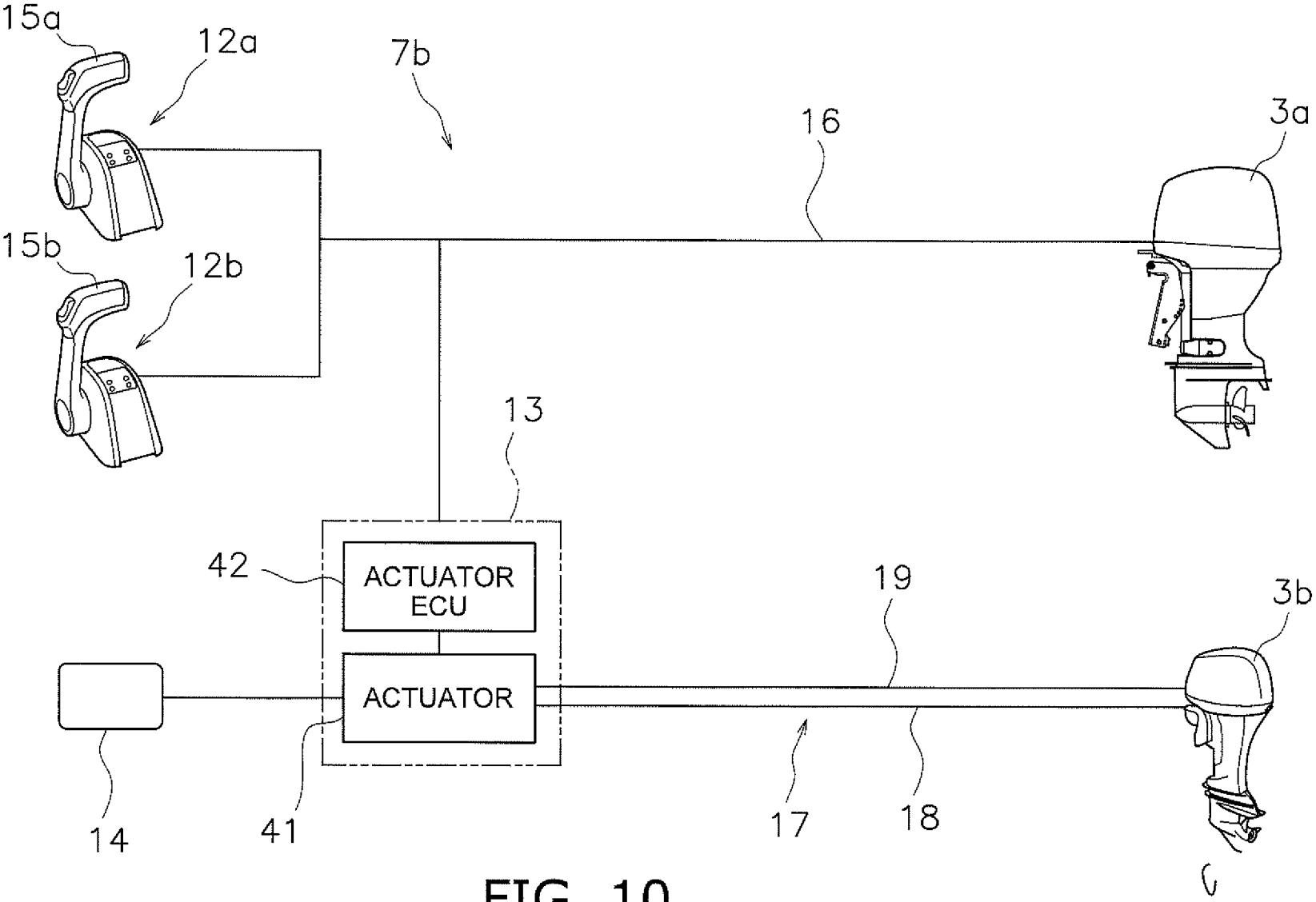
FIG. 10 is a schematic diagram of a system for operating a watercraft according to a modified preferred embodiment of the present invention.

In the above-described preferred embodiments, one remote control 12 is provided, but alternatively, two or more remote controls 12 may be provided. FIG. 10 is a schematic diagram of a vessel operating system 7*b* according to a second modified preferred embodiment of the present invention. The vessel operating system 7*b* includes a first remote control 12*a* and a second remote control 12*b*. The first and second remote controls 12*a* and 12*b* may be disposed in different locations. For example, the first remote control 12*a* may be disposed inside a cockpit of the watercraft 1, whereas the second remote control 12*b* may be disposed outside the cockpit of the watercraft 1.

The first remote control 12*a* includes a first operating tool 15*a*. The second remote control 12*b* includes a second operating tool 15*b*. Each of the first and second remote controls 12*a* and 12*b* preferably has a similar configuration to the above-described remote control 12. Each of the first and second operating tools 15*a* and 15*b* preferably has a similar configuration to the above-described operating tool 15. The first and second remote controls 12*a* and 12*b* are connected to the first outboard motor 3*a* and the actuator unit 13 through the first transmission path 16.

The actuator unit 13 may convert an electric operating signal, inputted thereto from either the first remote control 12*a* or the second remote control 12*b* through the first transmission path 16, into a mechanical operating amount and transmits the mechanical operating amount to the second outboard motor 3*b* through the second transmission path 17. The detailed configuration of controlling the second outboard motor 3*b* by the actuator unit 13 are preferably similar to that in the above-described preferred embodiments.

In the above-described preferred embodiments, when the first outboard motor 3*a* is made operable, the second outboard motor 3*b* is made inoperable and the shift mechanism 24*b* in the second outboard motor 3*b* is kept in the neutral state. However, when the first outboard motor 3*a* is made operable, the shift mechanism 24*b* may be set in the forward moving state while the engine 21*b* in the second outboard motor 3*b* is stopped. Accordingly, the propeller 28*b* in the second outboard motor 3*b* is inhibited from rotating along with the propeller 28*a* in the first outboard motor 3*a*.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A watercraft comprising:

a vessel body;

a first outboard motor attached to the vessel body and that receives an electric operating signal and is controlled in accordance with the electric operating signal;

a second outboard motor attached to the vessel body and that receives a mechanical operating amount and is controlled in accordance with the mechanical operating amount;

an operating tool that controls shifting and a throttle opening degree of each of the first and second outboard motors;

a first transmission path through which the electric operating signal is transmitted to the first outboard motor based on an operation of the operating tool;

a second transmission path through which the mechanical operating amount is transmitted to the second outboard motor based on an operation of the operating tool; and an actuator unit including an actuator and a controller, the actuator being connected to the second transmission path and the controller being configured or programmed to control the actuator to output the mechanical operating amount in accordance with the electric operating signal; wherein the actuator unit is located outside of the second outboard motor.

2. The watercraft according to claim 1, wherein the operating tool outputs the electric operating signal indicating the operation of the shifting and the throttle operating degree; and the controller is configured or programmed to receive the electric operating signal from the operating tool.

3. The watercraft according to claim 2, wherein the controller includes operating amount information defining a relationship between the electric operating signal and the mechanical operating amount.

4. The watercraft according to claim 2, further comprising:

an operational switch that switches which of the first and second outboard motors is operated by the operating tool.

5. The watercraft according to claim 4, wherein the operational switch is connected to the actuator unit.

6. The watercraft according to claim 4, wherein the controller is configured or programmed to output the electric operating signal inputted thereto from the operating tool to the first outboard motor through the first transmission path when the first outboard motor is made operable by the operational switch; and the controller is configured or programmed to compute the mechanical operating amount in accordance with the electric operating signal inputted thereto from the operating tool and control the actuator to output the mechanical operating amount to the second outboard motor through the second transmission path when the second outboard motor is made operable by the operational switch.

7. The watercraft according to claim 2, further comprising:

a second operating tool that controls the shifting and the throttle opening degree of the each of the first and second outboard motors; wherein the second operating tool is connected to the actuator unit and outputs the electric operating signal indicating the shifting and the throttle opening degree;

the controller is configured or programmed to receive the electric operating signal from the second operating tool; and the controller is configured or programmed to control the actuator to output the mechanical operating amount in accordance with the electric operating signal inputted thereto from the second operating tool.

8. A vessel operating system comprising:

a first outboard motor that receives an electric operating signal and is controlled in accordance with the electric operating signal;

a second outboard motor that receives a mechanical operating amount and is controlled in accordance with the mechanical operating amount;

an operating tool that controls shifting and a throttle opening degree of each of the first and second outboard motors;

a first transmission path through which the electric operating signal is transmitted to the first outboard motor based on an operation of the operating tool; and a second transmission path through which the mechanical operating amount is transmitted to the second outboard motor based on an operation of the operating tool; and an actuator unit including an actuator and a controller, the actuator being connected to the second transmission path and the controller being configured or programmed to control the actuator to output the mechanical operating amount in accordance with the electric operating signal; wherein the actuator unit is located outside of the second outboard motor.

9. The vessel operating system according to claim 8, wherein the operating tool outputs the electric operating signal indicating an operation of the shifting and the throttle operating degree; and the controller is configured or programmed to receive the electric operating signal from the operating tool.

10. The vessel operating system according to claim 9, wherein the controller includes operating amount information defining a relationship between the electric operating signal and the mechanical operating amount.

11. The vessel operating system according to claim 9, further comprising:

an operational switch that switches which of the first and second outboard motors is operated by the operating tool.

12. The vessel operating system according to claim 11, wherein the operational switch is connected to the actuator unit.

13. The vessel operating system according to claim 11, wherein the controller is configured or programmed to output the electric operating signal inputted thereto from the operating tool to the first outboard motor through the first transmission path when the first outboard motor is made operable by the operational switch; and the controller is configured or programmed to compute the mechanical operating amount in accordance with the electric operating signal inputted thereto from the operating tool and control the actuator to output the mechanical operating amount to the second outboard motor through the second transmission path when the second outboard motor is made operable by the operational switch.

14. The vessel operating system according to claim 9, further comprising:

a second operating tool that controls the shifting and the throttle opening degree of the each of the first and second outboard motors; wherein the second operating tool is connected to the actuator unit and outputs the electric operating signal indicating the shifting and the throttle opening degree;

the controller is configured or programmed to receive the electric operating signal from the second operating tool; and the controller is configured or programmed to control the actuator to output the mechanical operating amount in accordance with the electric operating signal inputted thereto from the second operating tool.

15. A watercraft comprising:

a vessel body;

a first outboard motor attached to the vessel body and that receives an electric operating signal and is controlled in accordance with the electric operating signal;

a second outboard motor attached to the vessel body and that receives a mechanical operating amount and is controlled in accordance with the mechanical operating amount;

an operating tool that controls shifting and a throttle opening degree of each of the first and second outboard motors;

a first transmission path through which the electric operating signal is transmitted to the first outboard motor based on an operation of the operating tool; and a second transmission path through which the mechanical operating amount is transmitted to the second outboard motor based on an operation of the operating tool;

wherein the second transmission path includes at least one cable that transmits the mechanical operating amount by pushing and pulling the at least one cable.

16. The watercraft according to claim 15, further comprising:

a shift actuator that controls the shifting of the first outboard motor; and a throttle actuator that controls the throttle opening degree of the first outboard motor.

17. The watercraft according to claim 16, further comprising:

a controller configured or programmed to control the shift actuator and the throttle actuator in accordance with the electric operating signal.

18. The watercraft according to claim 15, further comprising:

an actuator that controls the shifting and the throttle opening degree of the second outboard motor.

19. The watercraft according to claim 18, further comprising:

a controller configured or programmed to control the actuator to output the mechanical operating amount in accordance with the electric operating signal.

20. The watercraft according to claim 18, wherein the at least one cable includes a first cable that controls the shifting of the second outboard motor; and the actuator includes a first cable driver that pushes and pulls the first cable.

21. The watercraft according to claim 18, wherein the at least one cable includes a second cable that controls the throttle opening degree of the second outboard motor; and the actuator includes a second cable driver that pushes and pulls the second cable.

* * * * *